US010381712B2

(12) United States Patent
Chi et al.

(10) Patent No.: US 10,381,712 B2
(45) Date of Patent: Aug. 13, 2019

(54) DUAL-BAND WIRELESS LAN ANTENNA

(71) Applicant: Hewlett-Packard Development Company, L.P., Houston, TX (US)

(72) Inventors: David Chi, Taipei (TW); Shih-Huang Wu, Houston, TX (US); Po-Chao Chen, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,601

(22) PCT Filed: Jan. 20, 2016

(86) PCT No.: PCT/US2016/014038

§ 371 (c)(1),
(2) Date: Jan. 29, 2018

(87) PCT Pub. No.: WO2017/127062

PCT Pub. Date: Jul. 27, 2017

(65) Prior Publication Data

US 2018/0375191 A1 Dec. 27, 2018

(51) Int. Cl.
*H01Q 1/22* (2006.01)
*H01Q 1/38* (2006.01)
(Continued)

(52) U.S. Cl.
CPC ..... *H01Q 1/2291* (2013.01); *H01Q 1/2266* (2013.01); *H01Q 1/243* (2013.01);
(Continued)

(58) Field of Classification Search
CPC ..... H01Q 1/38; H01Q 1/2266; H01Q 1/52; H01Q 9/42; H01Q 21/0087; H01Q 5/30;
(Continued)

(56) References Cited

U.S. PATENT DOCUMENTS 9,099,789 B1 8/2015 Modro
2001/0050641 A1* 12/2001 Itoh ..... H01Q 1/38 343/700 MS
(Continued)

FOREIGN PATENT DOCUMENTS

DE 202004013971 U1 8/2005
DE 102008005496 B3 1/2009
WO WO-2010018896 A1 2/2010

OTHER PUBLICATIONS

Chou, J-H. et al., "A Novel LTE MIMO Antenna with Decoupling Element for Mobile Phone Application", 2014, pp. 697-700. http://www.ieice.org/proceedings/EMC14/contents/pdf/16A2-A3.pdf.
(Continued)

*Primary Examiner* — Graham P Smith
*Assistant Examiner* — Jae K Kim
(74) *Attorney, Agent, or Firm* — HPI Patent Department

(57) ABSTRACT

In one example, a dual-band wireless LAN antenna. The antenna includes plural antenna traces disposed in a first plane that is substantially parallel to, and spaced apart from, a plane of electrically conductive material. At least two of the traces are dimensioned to resonate at different frequencies. The antenna also includes a decoupling element disposed in a second plane between the first plane and the conductive plane. The decoupling element is electrically connected to a selected one of the antenna traces. The antenna further includes a conductor which is electrically connected to the decoupling element and to the conductive plane.

15 Claims, 6 Drawing Sheets

(51) Int. Cl.

| | |
|---|---|
| ***H01Q 1/52*** | (2006.01) |
| ***H01Q 9/42*** | (2006.01) |
| ***H01Q 5/378*** | (2015.01) |
| ***H01Q 5/30*** | (2015.01) |
| ***H01Q 1/24*** | (2006.01) |
| ***H01Q 21/00*** | (2006.01) |

(52) U.S. Cl.
CPC ..... *H01Q 1/38* (2013.01); *H01Q 1/52* (2013.01); *H01Q 1/523* (2013.01); *H01Q 5/30* (2015.01); *H01Q 5/378* (2015.01); *H01Q 9/42* (2013.01); *H01Q 21/0087* (2013.01)

(58) Field of Classification Search
CPC ..... H01Q 1/2291; H01Q 1/243; H01Q 1/523; H01Q 5/378
See application file for complete search history.

(56) References Cited

U.S. PATENT DOCUMENTS

2006/0181464 A1 8/2006 Erkocevic
2007/0182636 A1 8/2007 Carlson
2009/0262028 A1* 10/2009 Mumbru ..... H01Q 5/371 343/702
2011/0163928 A1 7/2011 Klos et al.
2011/0228713 A1 9/2011 Alexopoulos et al.
2011/0230136 A1* 9/2011 Washiro ..... H01P 5/187 455/41.1
2015/0044963 A1 2/2015 Konanur et al.
2015/0116159 A1* 4/2015 Chen ..... H01Q 5/22 343/702
2018/0191059 A1* 7/2018 Ko ..... H01Q 1/243
2018/0331575 A1* 11/2018 Ikefuji ..... H02J 7/00

OTHER PUBLICATIONS

The International Searching Authority, "The International Search Report and The Written Opinion, Application No. PCT/US2016/014038", dated Oct. 18, 2016, 10 pages.

* cited by examiner

DUAL-BAND WIRELESS LAN ANTENNA

CLAIM FOR PRIORITY

The present application is a national stage filing under 35 U.S.C. § 371 of PCT application number PCT/US2016/014038, having an international filing date of Jan. 20, 2016, the disclosure of which is hereby incorporated by reference in its entirety.

BACKGROUND

Many electronic devices include circuitry to connect the device to a wireless local area network (wireless LAN, or WLAN). Such circuitry allows the device to wirelessly connect to a computer network within the local coverage area of the WLAN, such as for example within a home, school, or office. The WLAN may also allow the device to connect through the WLAN to other networks outside the local coverage area, such as for example the Internet. Many wireless LANs are radio-based and comport with the IEEE 802.11 standard, often referred to as "Wi-Fi", which uses predefined frequency bands for the radio communication. Two of these frequency bands are 2.4 GHz and 5 GHz. Some electronic devices which implement WLAN connectivity provide circuitry for communication over both of these bands. Such electronic devices are often portable ones, such as notebook computers, tablet computers, or smart phones which can be moved around within the local coverage area. It is desirable for these devices to be able to reliably connect with, and interoperate with, the WLAN over as much of the local coverage area as possible.

DETAILED DESCRIPTION

Figure 1:
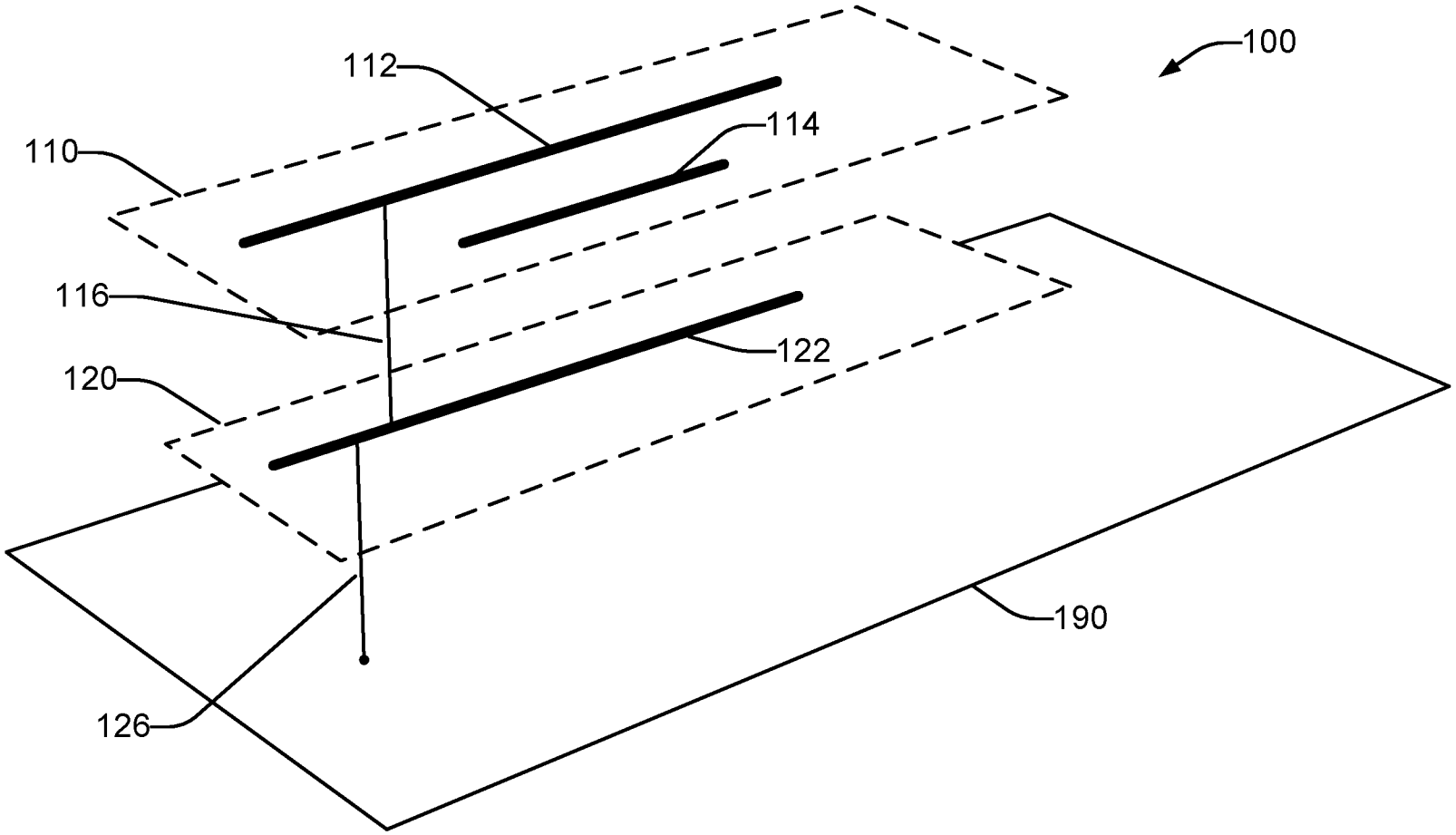
FIG. 1 is a schematic perspective representation of a wireless LAN antenna in accordance with an example of the present disclosure.

During development, many types of electronic devices, including portable and/or consumer devices, pay particular attention to industrial design factors. Industrial design considers the appearance of the device, in addition to its function, and looks to optimize these so as to give the device the greatest value possible.

In some cases, improving the appearance of an electronic device could undesirably degrade its functionality. For example, from an industrial design perspective, it would be desirable for many notebooks, tablets, and smart phones (among other electronic devices) to have a windowless metal cover in as thin an enclosure as possible. However, placing a WLAN antenna in close proximity to a windowless, electrically conductive metal cover can undesirably degrade the antenna performance, and thus the WLAN performance. The degradation may occur due to magnetic coupling and/or electric coupling between the antenna and the metal cover. In addition, the performance degradation can be more severe at some frequency bands than at others. For example, in some cases the coupling effects are more severe at 2.4 GHz, and less severe at 5 GHz. These effects could be mitigated by placing the antennas farther away from the windowless metal cover, but this would undesirably increase the thickness of the device. These effects could alternatively be mitigated by forming a window in the metal cover in the region adjacent to the antennas, but the plastic (or other non-conducting material) cover positioned over the window would undesirably affect the appearance of the device.

Referring now to the drawings, there is illustrated an example of a wireless LAN antenna which, when placed adjacent a plane of electrically conductive material, has reduced magnetic and/or electric coupling between the antenna and the cover. In some examples, the WLAN antenna is an omnidirectional antenna. This is advantageous because many electronic devices in which a WLAN antenna is used are portable and easily moved around by the user, or placed in various orientations by the user. An omnidirectional antenna enables electronic devices to connect to the network from various locations within the local coverage area of the WLAN, and/or with the devices placed in various orientations.

Considering now one example of a wireless LAN antenna having reduced magnetic and/or electric coupling between the antenna and an adjacent windowless, electrically conductive cover, and with reference to FIG. 1, a WLAN antenna 100 is placed adjacent an electrically conductive plane 190. Plural antenna traces 112, 114 are disposed in a first plane 110 that is substantially parallel to, and spaced apart from, the plane 190 of electrically conductive material. The antenna traces 112, 114 are each dimensioned to resonate (produce its resonant mode) at a different frequency. For example, the longer trace 112 may resonate at a lower frequency than the shorter trace 114. As used herein and in the claims, a "trace" may be a path or route of continuous electrically-conductive material, such as for example copper, gold, or alloys thereof.

A decoupling element 122 is disposed in a second plane 120. The second plane 120 is disposed between, and substantially parallel to, the first plane 110 and the conductive plane 190. The decoupling element 122 is electrically connected, by conductor 116, to the antenna trace 112.

The decoupling element 122 is also electrically connected, by conductor 126, to the conductive plane 190. The conductor 126 provides a grounding point to the antenna that defines the antenna boundary conditions for a resonant length that generates the proper resonant mode for the frequency at which the antenna trace 112 is to be operated.

The decoupling element 122, as connected, serves to reduce the magnetic and/or electric coupling between the antenna trace 112 and the conductive plane 190.

In one example, the antenna trace 112 is sized to resonate at 2.4 GHz, and the antenna trace 114 is sized to resonate at 5 GHz. Due to its higher resonant frequency, the antenna trace 114 exhibits significantly less coupling to the conductive plane 190 and thus there is no corresponding decoupling element electrically connected to the antenna trace 114. In other examples and/or frequencies, however, a decoupling element similar to decoupling element 122 could be connected between the antenna trace 114 and the conductive plane 190.

Figure 2A:
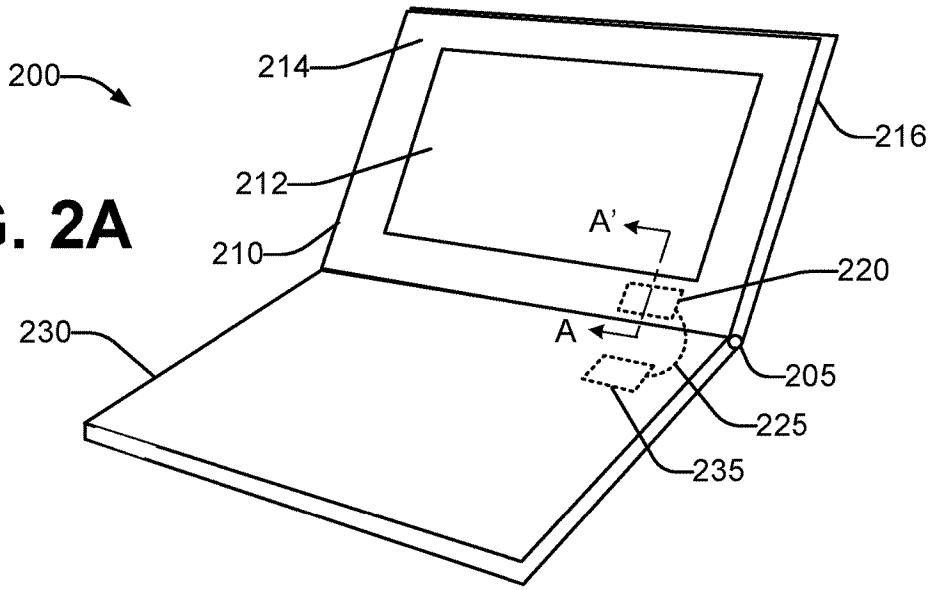
FIG. 2A is a schematic perspective representation of an electronic device having a wireless LAN antenna in accordance with an example of the present disclosure.
Figure 2B:
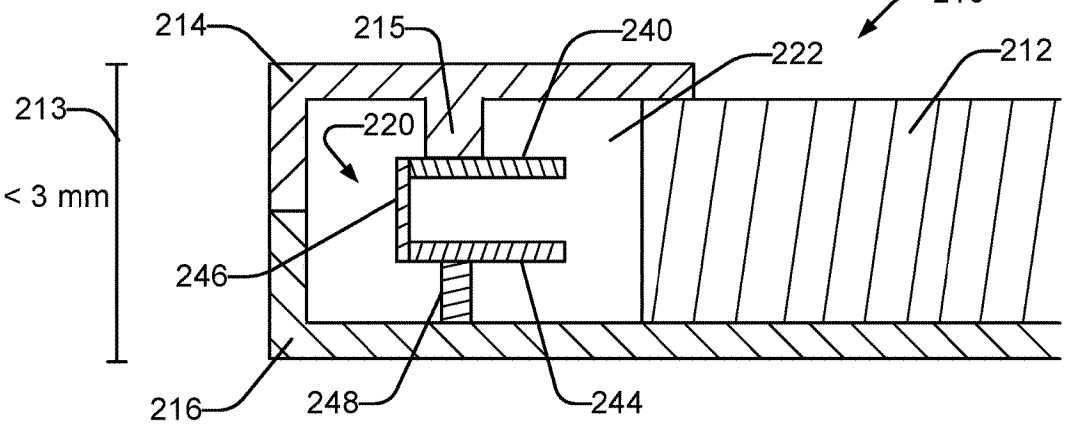
FIG. 2B is a cross-sectional side view of a display module of the electronic device of FIG. 2A in accordance with an example of the present disclosure.

Considering now an electronic device having a wireless LAN antenna, and with reference to FIGS. 2A-2B, one example of an electronic device is a notebook computer 200. The notebook 200 has a clamshell design, with a display module 210 coupled to a base module 230 by a hinge mechanism 205. The notebook 200 is illustrated in an "open" position in FIG. 2A. The hinge mechanism 205 allows the display module 210 to be rotated to a comfortable viewing angle for a user. The hinge mechanism 205 also allows the display module 210 to be rotated into a "closed" position in which the display module 210 is stacked on top of the base module 230.

The display module 210 includes a display 212. The display 212 is disposed adjacent a windowless conductive cover 216. In some examples, the conductive cover 216 is a metal cover. A bezel 214 is disposed at the opposite side of the display 212, and spaced apart from the conductive cover 216. The window of the bezel 214 allows the user to view the display 212. In examples, the bezel 214 is a non-conductive material, such as plastic.

The base module 230 includes a radio transceiver 235 for the wireless LAN. The display module 210 includes a WLAN antenna 220. A cable 225 connects the radio transceiver 235 and the WLAN antenna 220. The cable 225 carries a signal line and a ground. The cable 225 may be a coaxial cable, where the signal line is the interior conductor of the cable 225, and the ground is the conductive shell of the cable 225.

FIG. 2B illustrates a cross-sectional view of the display module 210 along lines A-A'. The display 212 is disposed between the conductive cover 216 and the bezel 214. The WLAN antenna 220 is also disposed between the conductive cover 216 and the bezel 214, in the border region around the display 212. Plural antenna traces are disposed in a first layer 240 that is substantially parallel to the conductive cover 216. A decoupling element is disposed in a second layer 242, which in turn is also substantially parallel to the conductive cover 216, and disposed between the first layer 240 and the windowless conductive cover 216. A first conductor 246 extending between the layers 240, 242 electrically connects the decoupling element in the second layer 242 to one of the antenna traces of the first layer 240. The first conductor 246 may be a wire, a trace, or another type of electrical connection. In some examples, a non-electrically conductive spacer (not shown) is disposed between, and in mechanical contact with, the layers 240, 242. The spacer maintains the spacing between the layers within a desired range. The layers 240, 242 may contact the spacer and/or be affixed to the spacer. The spacer may be compressible or solid. The spacer may be plastic.

A second conductor 248 electrically connects the decoupling element in the second layer 242 to the windowless conductive cover 216. In some examples, the second conductor 248 may also serve to mechanically mount the second layer 242, or the entire WLAN antenna 220, to the conductive cover 216. In such examples, the second conductor 248 provides appropriate rigidity and strength to the mechanical connection between the WLAN antenna 220 and the cover 216. In some examples, the second conductor 248 may be an electrically-conductive spring.

In one example, the total thickness 213 of the display module 210 is less than 3 millimeters. The WLAN antenna 220 is sized to fit within the interior cavity 222 of the display module 210 that is formed by the bezel 214 and the cover 216. The bezel 214 includes a feature 215 which contacts a surface of the WLAN antenna 220, such as for example a surface of the layer 240, to hold the WLAN antenna 220 in a fixed position within the cavity 222. In examples where the second conductor 248 is a spring, the feature 215 may compress the spring 248 towards the cover 216.

Figure 3A:
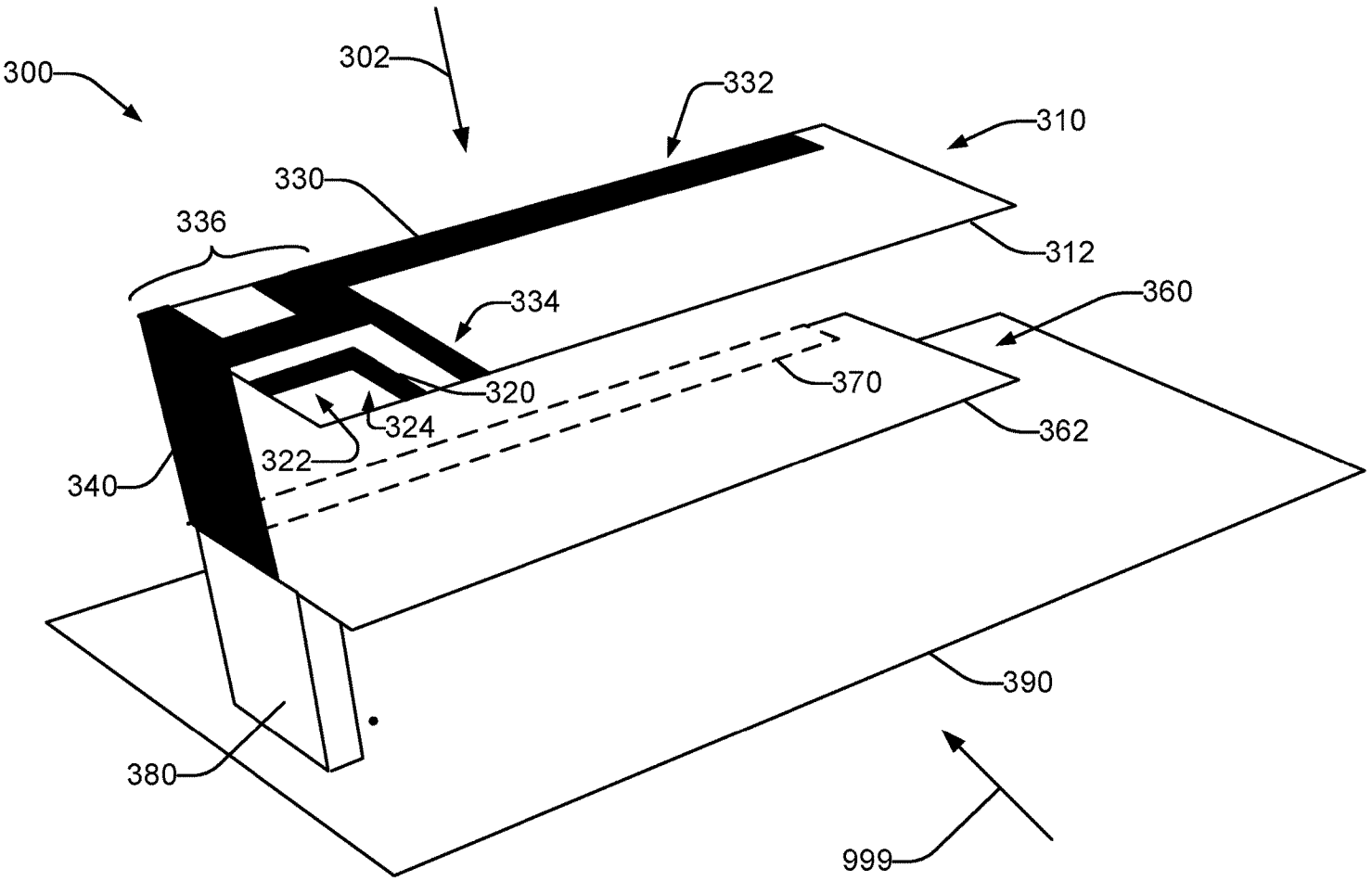
FIG. 3A is a schematic perspective representation of another wireless LAN antenna in accordance with an example of the present disclosure.

Considering now another example of a wireless LAN antenna having reduced magnetic and/or electric coupling between the antenna and an adjacent windowless, electrically conductive cover, and with reference to FIGS. 3A through 3D, a WLAN antenna 300 includes a top planar layer 310 and a bottom planar layer 360. FIG. 3A illustrates a perspective view of the WLAN antenna 300. The layers 310, 360 are disposed above a plane 390 of electrically conductive material, which may be a metal cover of an electronic device which includes the WLAN antenna 300. The layers 310, 360 and the conductive plane 390 are all substantially parallel to each other, and the bottom layer 360 being disposed between the top layer 310 and the conductive plane 390. The layers 310, 360 and the conductive plane 390 may be spaced apart by distances that optimally reduce the magnetic and/or electric coupling between the antenna 300 and the plane 390.

Figure 3B:
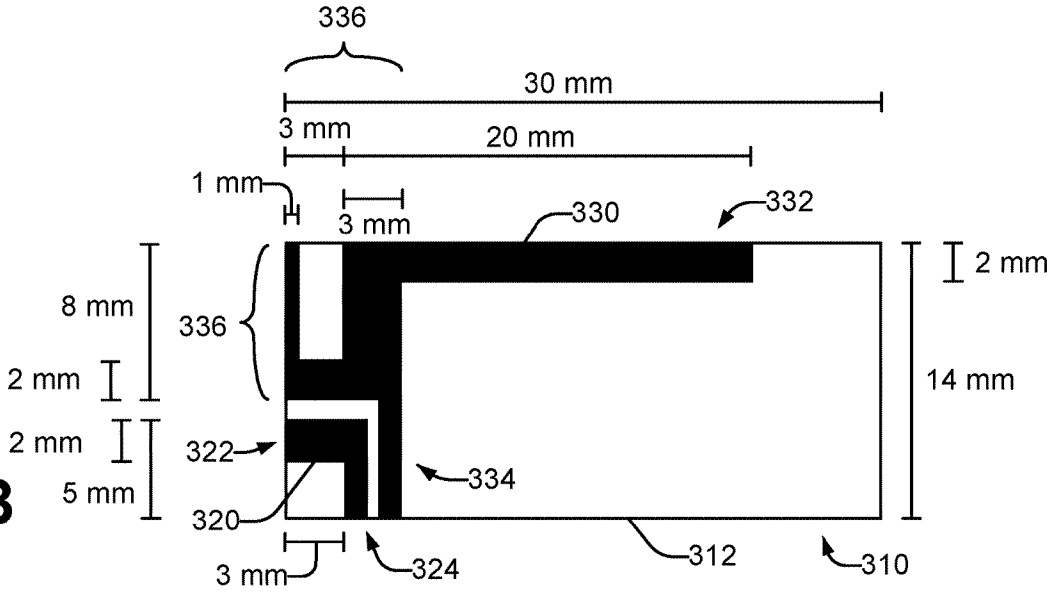
FIG. 3B is a top view of a first circuit board of the wireless LAN antenna of FIG. 3A in accordance with an example of the present disclosure.
Figure 3C:
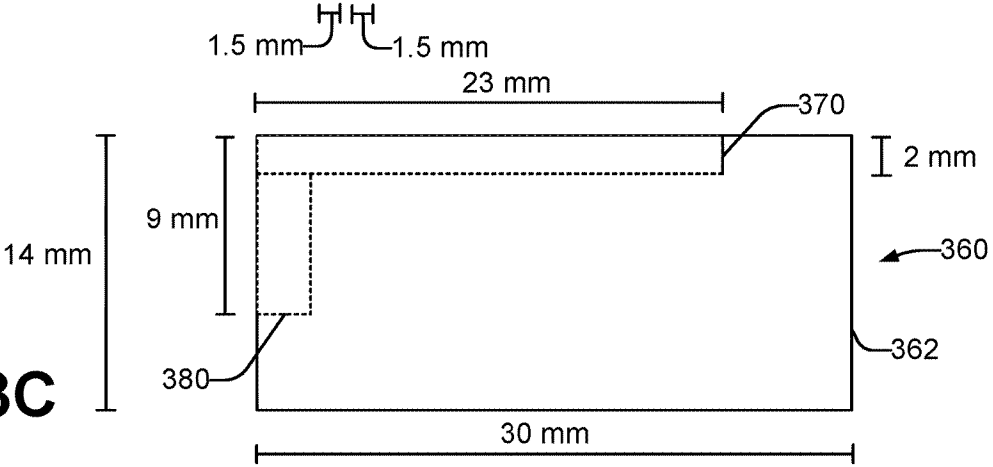
FIG. 3C is a top view of a second circuit board of the wireless LAN antenna of FIG. 3A in accordance with an example of the present disclosure.

In some examples, the layers 310, 360 include printed circuit boards 312, 362 respectively. Electrically conductive traces are formed on the printed circuit boards 312, 362. The traces may be formed, for example, by deposition of electrically conductive material in the appropriate shape and with the appropriate dimensions. FIGS. 3B and 3C illustrate top views, in the direction 302, of the top circuit board 312 and bottom circuit board 362 respectively. A non-electrically conductive spacer 385 (FIG. 3D; not shown in FIG. 3A for clarity of illustration) may be disposed between, and in mechanical contact with, the printed circuit boards 312, 362 to maintain the desired spacing between the PCBs 312, 362. The PCBs 312, 362 may be attached to the spacer. Alternatively, the layers 310, 360 may be opposite sides of a single PCB that is of sufficient thickness to provide the desired spacing between the layers 310, 360.

Plural antenna traces 320, 330 are formed on the top PCB 312. In some examples, the traces 320, 330 are formed on the side of the PCB 312 that is facing away from the conductive plane 390. The antenna traces 320, 330 are dimensioned to resonate at different frequencies. In one example, antenna trace 320 resonates at a frequency in the 5 GHz band, while antenna trace 330 resonates at a frequency in the 2.4 GHz band.

The antenna trace 320 has a substantially linear radiation arm 322 which transmits and/or receives radio signals in the 5 GHz band. In one example, a ground line of a transceiver (not shown) is electrically connected to a parasitic radiation arm (ground arm) 324 of the antenna trace 320. One end of the parasitic radiation arm 324 is connected to the radiation arm 322, and the ground line of the transceiver may be connected to the parasitic radiation arm 324 at or near the opposite end.

The antenna trace 330 has a substantially linear radiation arm 332 which transmits and/or receives radio signals in the 2.4 GHz band. In one example, a signal line of a transceiver (not shown) is electrically connected to a feed arm 334 of the antenna trace 330. The signal line may be connected at or near one end of the feed arm 334. The other end of the feed arm 334 is connected to a U-shaped portion 336 of the antenna trace 330. The U-shaped portion 336 lets the antenna trace 330 have a shorter length (along the direction of the radiation arm 332) and resonate properly in the 2.4 GHz band than if the antenna trace 330 were entirely substantially linear. One end of the radiation arm 332 is also connected to the U-shaped portion 336.

A decoupling element 370 is formed on the bottom PCB 362. In some examples, the decoupling element 370 is formed on the side of the PCB 362 that faces towards the conductive plane 390. As such, the decoupling element 370 is illustrated in FIGS. 3A, 3C with dashed lines. The decoupling element 370 is electrically connected to the antenna trace 330 for the 2.4 GHz band by a conductor 340, because the 2.4 GHz trace 330 exhibits significantly more affinity for magnetic and/or electric coupling to the conductive plane 390 than does the 5 GHz antenna trace 320. In one example, the conductor 340 is a conductive strip, one end of which is electrically connected at the edge of the PCB 312 to the left arm of the U-shaped 336 portion of the antenna trace 330. The other end of the conductor 340 is connected to the decoupling element 370 at the edge of the PCB 362. The conductor 340 may be formed on and/or affixed to an outer surface of the spacer 385. The conductor 340 may alternatively be formed within the spacer 385. In examples where the decoupling element 370 is deposited on the opposite side of a single PC board from the antenna traces 320, 330, the conductor 340 may be at least one via formed through the PC board.

The decoupling element 370 tends to cancel the magnetic and/or electric coupling between the antenna trace 330 and the conductive plane 390, so that the radiation arm 332 of the antenna trace 330 can more effectively radiate energy and/or receive radiated energy. The decoupling element 370 accomplishes this, at least in part, by generating a reverse wave that is 180 degrees out of phase with the wave on the antenna trace 330. The reverse wave tends to cancel out the coupling between the antenna trace 330 and the conductive plane 390. This results in improved transmission and/or reception.

A conductive spring 380 electrically connects the decoupling element 370 to the conductive plane 390. One portion of the spring 380 contacts, and in some examples is affixed to, the decoupling element 370 and/or the conductor 340 at the bottom side of the PCB 362, while another portion contacts the conductive plane 390. During assembly of an electronic device that includes the WLAN antenna 300, the spring 380 is compressed in the direction orthogonal to the conductive plane 390 (which may in some examples be a windowless metal cover of the electronic device). This ensures good electrical contact between the WLAN antenna 300 and the conductive plane 390. In one example, the spring 380 is compressed to a height orthogonal to the conductive plan 390 of about 0.5 millimeters. A variety of spring types may be used, as long as the spring 380 is conductive and makes good electrical contact with both the decoupling element 370 and the conductive plane 390. For example, the spring 380 may be a compression spring, a leaf spring, or another suitable type of spring. In one example, the spring 380 is compressed by a feature 396 of a non-conductive bezel 395 of the electronic device. The feature 396 contacts the WLAN antenna 300, for example at PCB 312, and exerts the compressive force.

Figure 3D:
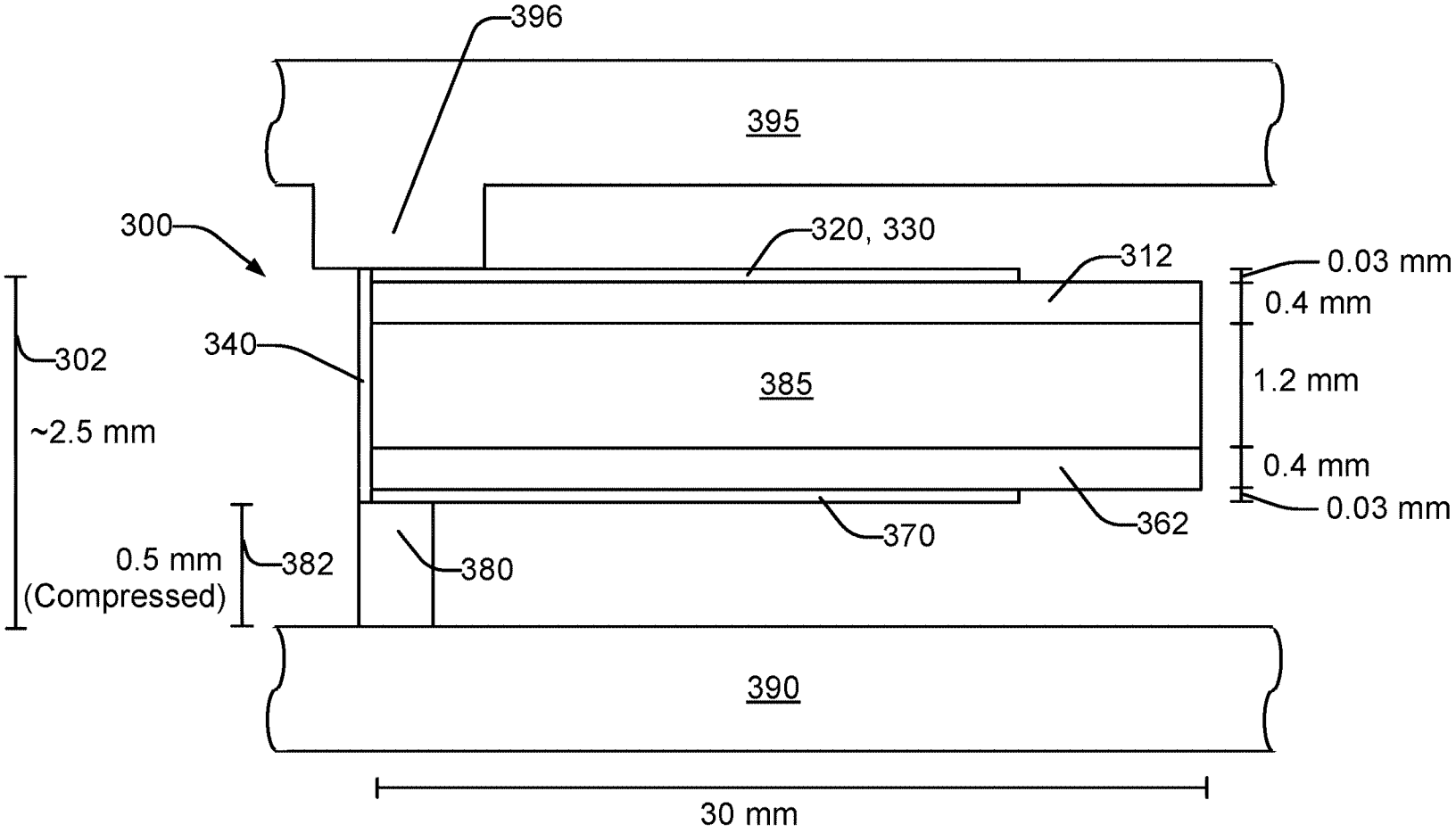
FIG. 3D is a side view of the wireless LAN antenna of FIG. 3A in accordance with an example of the present disclosure.

Considering further the dimensions of the example WLAN antenna 300, and with continued reference to FIGS. 3B through 3D, the WLAN antenna 300 is miniaturized. The PCBs 312, 362 are stacked vertically in the WLAN antenna 300, and looking in direction 302 each PCB 312, 362 is 14 millimeters by 30 millimeters in size in one example. When installed (i.e. with the spring 380 compressed, the height of the WLAN antenna 300 above the conductive plane 390 is about 2.5 millimeters in one example. The miniaturized dimensions of the WLAN antenna 300 allow an electronic device which includes the WLAN antenna 300 to be thinner and smaller.

The decoupling element 370 is disposed in the same position on the PCB 362 as the radiation arm 332 of the 2.4 GHz antenna trace 330 is on the PCB 312. Thus when the PCBs 312, 362 are stacked as in FIG. 3A, the decoupling element 370 is disposed between the radiation arm 332 and the conductive plane 390. This arrangement optimizes the reduction in magnetic and/or electric coupling between the antenna trace 330 and the conductive plane 290. This reduced coupling advantageously improves the performance of WLAN communications of a device using the WLAN antenna 300. For example, increased signal strength is received at and/or transmitted from the WLAN antenna 300, which in turn improves the reliability of WLAN communications and/or increases the distance of WLAN communications within the local coverage area of the WLAN.

In one example, the antenna traces 320, 330 vary in width from about 1 millimeter to about 3 millimeters at different locations, as illustrated in FIGS. 3B-3C. The decoupling element 370 is substantially the same width as the radiation arm 332, in one example about 2 millimeters. With regard to the height of the WLAN antenna 300 above the conductive plane 390, and with reference to FIG. 3D, the spring 380 can be compressed in one example to a height 382 of about 0.5 millimeters in the direction 302. For an example thickness of PCBs 312, 362 of 0.4 millimeters, the spacer 385 is about 1.2 millimeters in thickness. The approximately 0.03 millimeter thicknesses of the antenna traces 320, 330 and the decoupling element 370 have a marginal effect on the overall thickness 302 of the WLAN antenna 300 of about 2.5 millimeters.

Figure 4:
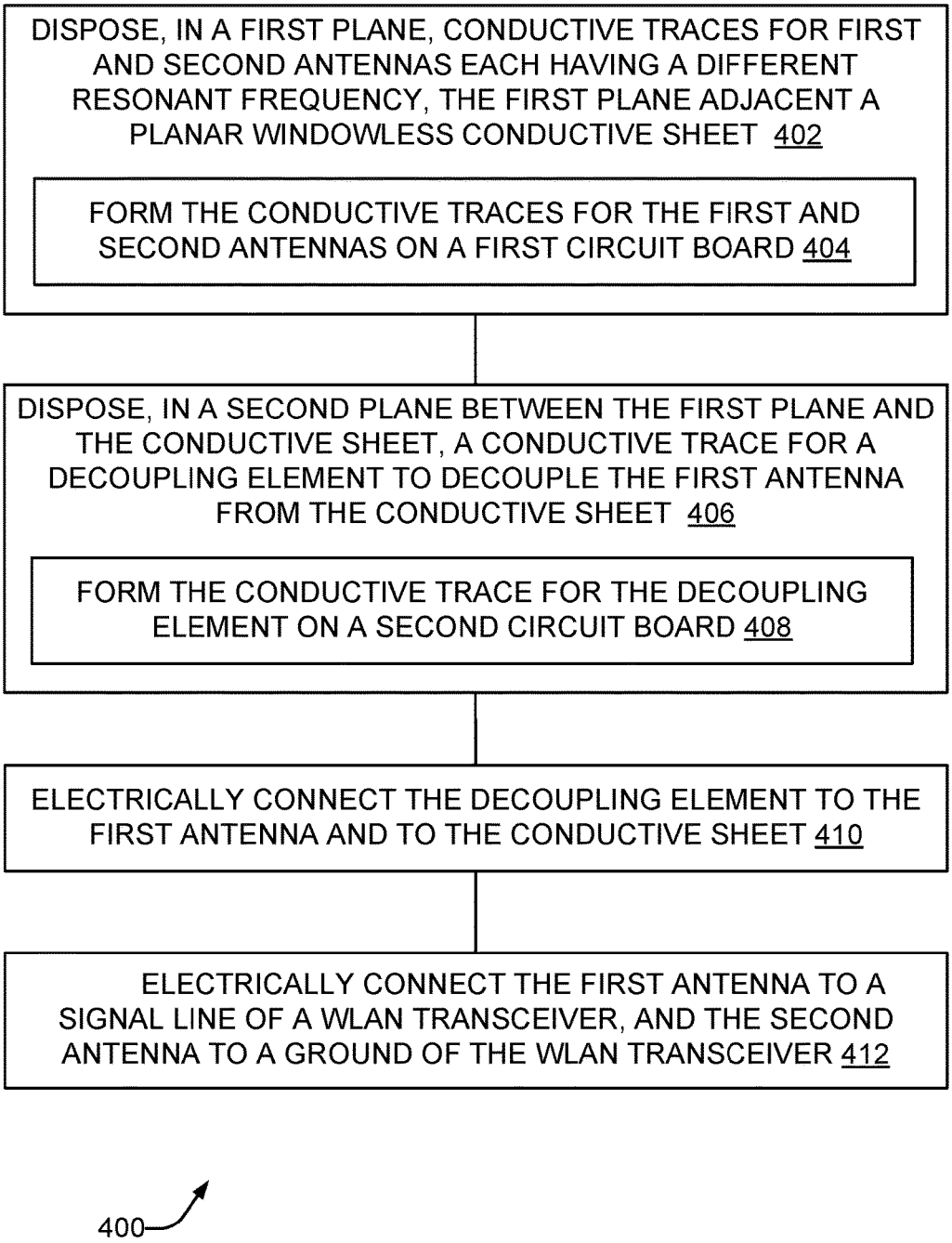
FIG. 4 is a flowchart in accordance with an example of the present disclosure of a method of fabricating a dual-band wireless LAN antenna.

Considering now one example method of fabricating a dual-band wireless LAN antenna, and with reference to FIG. 4, a method 400 begins at 402 by disposing, in a first plane, conductive traces for first and second antennas each having a different resonant frequency, the first plane adjacent a planar windowless conductive sheet. In some examples, the conductive traces for the first and second antennas are formed on a first circuit board at 404. At 406, the method 400 includes disposing, in a second plane between the first plane and the planar conductive sheet, a conductive trace for a decoupling element to decouple the first antenna from the conductive sheet. In some examples, at 408, the conductive trace for the decoupling element is formed on a second circuit board.

At 410, the decoupling element is electrically connected to the first antenna and to the conductive sheet.

At 412, in some examples, the first antenna is electrically connected to a signal line of a WLAN transceiver, and the second antenna is electrically connected to a ground of the WLAN transceiver.

A WLAN antenna 100, 200, 300 which includes a decoupling element provides better antenna performance when placed adjacent a windowless conductive cover as a result of the reduced magnetic and/or electric coupling between the antenna and the cover relative to prior WLAN antennas. For example, a single layer PIFA WLAN antenna (which does not have a decoupling element), or a monopole WLAN antenna (which does not have a grounding pin), placed adjacent a windowless metal cover has a passive three-dimensional average antenna gain, as measured by a vector network analyzer, of about minus 8 to minus 10 dB. The WLAN antenna 100, 220, 300 improves passive antenna performance relative to a single-layer PIFA WLAN antenna, and relative to a monopole WLAN antenna, by 50% or more. In one example, the three-dimensional antenna performance of the WLAN antenna 100, 220, 300 is minus 6 dB or better. The active transmit and/or receive performance of the WLAN antenna, when operated in an electronic device, is also correspondingly better than that of a single layer PIFA WLAN antenna, or a monopole WLAN antenna.

Terms of orientation and relative position (such as "top," "bottom," "side," and the like) are not intended to indicate a particular orientation of any element or assembly, and are used for convenience of illustration and description.

From the foregoing it will be appreciated that the antenna, electronic device, and method provided by the present disclosure represent a significant advance in the art. Although several specific examples have been described and illustrated, the disclosure is not limited to the specific methods, forms, or arrangements of parts so described and illustrated. For instance, the antenna traces and/or decoupling element could have a different shape than those which are illustrated if the electronic device imposes different size constraints on the WLAN antenna 100, 220, 300. This description should be understood to include all new and non-obvious combinations of elements described herein, and claims may be presented in this or a later application to any new and non-obvious combination of these elements. The foregoing examples are illustrative, and different features or elements may be included in various combinations that may be claimed in this or a later application. Unless otherwise specified, operations of a method claim need not be performed in the order specified. Similarly, blocks in diagrams or numbers (such as (1), (2), etc.) should not be construed as operations that proceed in a particular order. Additional blocks/operations may be added, some blocks/operations removed, or the order of the blocks/operations altered and still be within the scope of the disclosed examples. Further, methods or operations discussed within different figures can be added to or exchanged with methods or operations in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. An electronic device, comprising:

an enclosure having a windowless metal cover; and a dual-band wireless LAN antenna, disposed adjacent the windowless metal cover, having plural antenna traces disposed in a first layer substantially parallel to the windowless metal cover, a decoupling element disposed in a second layer disposed between the first layer and the windowless metal cover and electrically connected to one of the antenna traces, and a conductor electrically connecting the decoupling element to the windowless metal cover.

2. The device of claim 1, wherein the first layer is disposed on a first circuit board and the second layer is disposed on a second circuit board.

3. The device of claim 1, comprising:

a radio transceiver coupled to the wireless LAN antenna and having a signal line connected to a 2.4 GHZ antenna trace of the wireless LAN antenna and a ground line connected to a 5 GHz antenna trace of the wireless LAN antenna.

4. The device of claim 1, wherein the second layer is substantially parallel to the first layer and to the windowless metal cover.

5. The device of claim 1, comprising:

a display disposed adjacent the windowless metal cover; and a non-conductive bezel disposed around the display and above the windowless metal cover, wherein the wireless LAN antenna is disposed between the bezel and the windowless metal cover.

6. The device of claim 1, wherein the display, the bezel, and the windowless metal cover are disposed in a first module hingedly connectable to a second module, wherein the wireless LAN antenna is disposed in the first module adjacent a member of the bezel nearest the second module and electrically connected to a radio transceiver in the second module.

7. The device of claim 1, wherein the device has WiFi connectivity, and the device is one of a notebook computer, a tablet computer, or a phone.

8. A dual-band omnidirectional wireless LAN antenna, comprising:

plural antenna traces disposed in a first plane substantially parallel to, and spaced apart from, a plane of electrically conductive material, at least two of the traces dimensioned to resonate at different frequencies;

a decoupling element disposed in a second plane between the first plane and the conductive plane and electrically connected to a selected one of the antenna traces; and a conductor electrically connected to the decoupling element and the conductive plane.

9. The antenna of claim 8, wherein the selected antenna trace has a substantially linear radiation arm connected to a U-shaped portion and a feed arm connected to the U-shaped portion, the signal line of the selected antenna trace connectable to a signal line of a WLAN transceiver.

10. The antenna of claim 8, wherein the selected antenna trace has a radiation arm, and wherein the decoupling element is disposed between the radiation arm and the conductive plane.

11. The antenna of claim 8, wherein the selected trace is dimensioned to resonate at 2.4 GHz, and a second one of the antenna traces is dimensioned to resonate at 5 GHz.

12. The antenna of claim 8, wherein the decoupling element reduces at least one of electric coupling or magnetic coupling between the selected trace and the conductive plane.

13. A method of fabricating a dual-band omnidirectional wireless LAN antenna, comprising:

disposing, in a first plane, conductive traces for first and second antennas each having a different resonant frequency, the first plane adjacent a windowless conductive sheet;

disposing, in a second plane between the first plane and the conductive sheet, a conductive trace for a decoupling element to decouple the first antenna from the conductive sheet; and electrically connecting the decoupling element to the first antenna and to the conductive sheet.

14. The method of claim 13, comprising:

forming the conductive traces for the first and second antennas on a first circuit board; and forming the conductive trace for the decoupling element on a second circuit board.

15. The method of claim 13, comprising:

electrically connecting the first antenna to a signal line of a WLAN transceiver; and electrically connecting the second antenna to a ground of the WLAN transceiver.

* * * * *